US011060218B2

(12) United States Patent
Golin et al.

(10) Patent No.: US 11,060,218 B2
(45) Date of Patent: Jul. 13, 2021

(54) MACHINE FOR MAKING AN UPPER FOR A SHOE AND AN UPPER FOR A SHOE

(71) Applicant: JVC HOLDING SRL, Brescia (IT)

(72) Inventors: Giuseppe Golin, Brescia (IT); Paolo Lenzi, Mantova (IT)

(73) Assignee: JVC HOLDING SRL, Brescia (IT)

( * ) Notice: Subject to any disclaimer, the term of this patent is extended or adjusted under 35 U.S.C. 154(b) by 192 days.

(21) Appl. No.: 16/339,276

(22) PCT Filed: Oct. 11, 2017

(86) PCT No.: PCT/EP2017/075964
§ 371 (c)(1),
(2) Date: Apr. 3, 2019

(87) PCT Pub. No.: WO2018/069406
PCT Pub. Date: Apr. 19, 2018

(65) Prior Publication Data

US 2019/0226130 A1 Jul. 25, 2019

(30) Foreign Application Priority Data

Oct. 13, 2016 (IT) ..... 102016000102672

(51) Int. Cl.
*D04B 15/46* (2006.01)
*D04B 9/20* (2006.01)
(Continued)

(52) U.S. Cl.
CPC ..... *D04B 15/46* (2013.01); *D04B 1/22* (2013.01); *D04B 9/20* (2013.01); *D04B 9/42* (2013.01);
(Continued)

(58) Field of Classification Search
CPC . D04B 15/46; D04B 1/22; D04B 9/20; D04B 9/42; D04B 15/14; D04B 15/322
See application file for complete search history.

(56) References Cited

U.S. PATENT DOCUMENTS 1,424,025 A 7/1922 Lawson
2,147,197 A * 2/1939 Glidden ..... A43B 23/0235 36/9 R
(Continued)

FOREIGN PATENT DOCUMENTS

EP 0 882 827 A2 12/1998
WO 03/076705 A1 9/2003

OTHER PUBLICATIONS

International Search Report and Written Opinion issued in corresponding International Patent Application No. PCT/EP2017/075964 dated Jan. 18, 2018.

*Primary Examiner* — Danny Worrell
(74) *Attorney, Agent, or Firm* — Troutman Pepper Hamilton Sanders LLP

(57) ABSTRACT

The machine for making an upper for a shoe comprises a reel holder rack, a dial and a sinker crown, a needle cylinder with a vertical axis and forward and backward movement having a plurality of grooves, inside of which the (needles) are slidable, controlled by selection means thereof, a cup element, at least four feeders assembled along the circumference of the machine, guide means, first braking means, first recovery means for recovering each of the threads to be fed to said needles for forming the upper and a suction bell for unloading said upper, below said first braking means at least second braking means being present for braking or locking each thread for the formation of said upper during at least the first part of the return movement of said needle holder cylinder and second recovery means for recovering said thread from said cylinder, preventing its recovery by a reel
(Continued)

of said reels, said second braking means being activated and deactivated by said second recovery means.

20 Claims, 9 Drawing Sheets

(51) Int. Cl.

| | |
|---|---|
| ***D04B 1/22*** | (2006.01) |
| ***D04B 15/44*** | (2006.01) |
| ***D04B 9/42*** | (2006.01) |
| ***D04B 15/14*** | (2006.01) |
| ***D04B 15/32*** | (2006.01) |
| ***D04B 15/88*** | (2006.01) |

(52) U.S. Cl.
CPC ..... *D04B 15/14* (2013.01); *D04B 15/322* (2013.01); *D04B 15/44* (2013.01); *D04B 15/88* (2013.01); *D10B 2501/043* (2013.01)

(56) References Cited

U.S. PATENT DOCUMENTS

| | | | | | |
|---|---|---|---|---|---|
| 2,675,631 | A * | 4/1954 | Carr | ..... | A43B 1/04 36/9 R |
| 4,785,558 | A * | 11/1988 | Shiomura | ..... | A43B 1/04 36/114 |
| 7,131,296 | B2 * | 11/2006 | Dua | ..... | A43B 1/04 66/178 R |
| 9,877,536 | B2 * | 1/2018 | Huffman | ..... | A43B 1/04 |
| 10,077,512 | B2 * | 9/2018 | Kuo | ..... | D04B 1/00 |
| 10,182,617 | B2 * | 1/2019 | Craig | ..... | A43B 1/04 |
| 2005/0115284 | A1 | 6/2005 | Dua | | |

* cited by examiner

MACHINE FOR MAKING AN UPPER FOR A SHOE AND AN UPPER FOR A SHOE

CROSS REFERENCE TO RELATED APPLICATIONS

This is a U.S. national phase application under 35 U.S.C. § 371 of International Patent Application No. PCT/EP2017/075964, filed Oct. 11, 2017, which claims priority of Italian Patent Application No. 102016000102672, filed Oct. 13, 2016. The entire contents of these applications are hereby incorporated by reference.

FIELD OF INVENTION

The present invention relates to a machine for making an upper for a shoe and also to the upper and consequently to the shoe thus made.

BACKGROUND

As is well known, present-day sports footwear generally comprises two primary elements: an upper and a sole.

After being formed, the upper is fixed to the sole, whose task is to reduce reaction forces while the user is walking thanks to different layers making it up, such as, for example, a central layer of the sole and a tread.

In particular, the central layer has the task of protecting and ensuring the comfort of the foot, whereas the tread that of protecting the central layer.

In fact, the tread must be wear resistant and must guarantee the user maximum traction on the ground.

The upper can be made of different materials, which can be leather, polymeric materials, materials situated inside the upper to improve the comfort thereof and textile materials to favour the breathing of the foot.

The foregoing implies that an upper must sometimes be made with several parts made of different materials which must subsequently be assembled together by stitching or the use of glues or else by hot melting of some types of materials.

This implies high manufacturing costs due to lengthy production times, the use of specialised labour and considerable wastes of material.

Uppers have also been made on knitting machines with the use of a single thread to reduce the stitching of the upper and production waste.

However, not being shaped, an upper made on these machines requires further processing which increases the production costs thereof.

Recently, circular hosiery machines have been used to make an upper for shoes, but with poor results, essentially due to the impossibility of using on these machine yarns of a different count and a different texture, which can be soft, springy, rough or smooth.

Furthermore, on this type of machines it is not possible to use yarns with certain physical characteristics, such as, for example, elasticity or resistance, or yarns with a particular twist or caged, knop or flocked yarns and still others.

This limitation implies that the upper of a shoe, made on this type of machinery, will not be able to have different mechanical and physical characteristics of significance in the different areas making it up.

Such an upper, therefore, is not suitable for use in sports applications and/or at a professional level or for heavy-duty uses, such as hiking and mountaineering or marathons, or even everyday use where a high degree of comfort and pleasing aesthetics are required.

SUMMARY

The task of the present invention is to provide a machine for making an upper for a shoe which overcomes the above-mentioned limitations of the prior art.

Within the scope of this task, an important object of the invention is to provide a machine for making an upper for a shoe that enables any type of yarn having any physical characteristic whatsoever to be used, based on the mechanical characteristics and comfort that the upper must have.

It is a further object of the invention to provide a machine for making an upper for a shoe that enables all of its parts to be made in a short time and without limitations, with no need for further processing.

It is a further object of the invention to provide a machine for making an upper for a shoe that enables the mechanical characteristics of the upper to be varied along with the conformation thereof according to need, without any structural modification of the machine.

It is a further object of the invention to provide a machine for making an upper for a shoe that allows the means of holding the upper on the foot of the user and the means of holding the same to the sole thereof to be made simultaneously with the upper.

It is a further object of the invention to provide a machine for making an upper for a shoe that enables any type of yarn to be used in order also to obtain the eyelets and/or the tongue of the shoe simultaneously with the upper.

It is a further object of the invention to provide a machine for making an upper for a shoe wherein some parts are made with elastic yarns.

It is a further object of the invention to provide a machine for making an upper for a shoe, wherein the latter is made up of only two parts: the upper with elastic parts and/or eyelets and/or a tongue for optimal holding on the foot of the user and the sole.

It is a further object of the invention to provide a machine for making an upper for a shoe that enables normal working stitches to be executed and tuck stitches to be executed with four groups of actuators and preferably even with only two groups of selection actuators for each feed.

It is a further object of the invention to provide a machine for making an upper for a shoe that considerably simplifies the profile of the needle cams, since the latter only have the function of bringing about a lowering of the needles after they have engaged the yarn at a pre-established feed.

It is a further object of the invention to provide a machine for making an upper for a shoe that prevents breakage of the needles.

This task as well as these and other objects are achieved by a machine 1 for making an upper 2 for a shoe 3 characterised in that it comprises a reel holder rack 4, a dial 5 and a sinker crown 6, a needle cylinder 7 with a vertical axis and forward and backward movement having a plurality of grooves 8 inside of which the needles 9 are slidable, controlled by selection means 10 thereof, a cup element 11, at least four feeders 12 assembled along the circumference of the machine, guide means 13, first braking means 14, first recovery means 15 for recovering each of the threads 18 to be fed to said needles 9 for forming the upper and a suction bell 16 for unloading said upper 2, below said first braking means at least second braking means 20 being present for braking or locking each thread 18 for the formation of said upper during at least the first part of the return movement of said needle holder cylinder 7 and second recovery means 21 for recovering said thread 18 from said cylinder 7, preventing its recovery by a reel 22 of said reels, said second braking means 20 being activated and deactivated by said second recovery means 21.

The invention also relates to an upper for shoes characterised in that it comprises connection means for holding it onto the neck of the foot of the user, said connection means being provided on said upper simultaneously with its formation on a machine for making uppers.

The dependent claims better specify further features of the machine for making an upper for a shoe, wherein below the first braking means, there are at least second braking means for braking or locking each thread for the formation of said upper during at least the first part of the return movement of said needle holder cylinder and second recovery means for recovering said thread from said cylinder, preventing its recovery by a reel of said reels, said second braking means being activated and deactivated by said second recovery means.

The second braking means are supported by an adjustable support element at different distances from said second recovery means for anticipating or delaying the activation of said second braking means.

The machine further comprises braking means that only act on at least one elastic thread of said threads that form said upper, said third braking means being activated directly by the management program of said machine while said upper is being made.

There are also third recovery means only acting on said elastic thread which must be subjected to the lowest friction and tension possible in order for it to be correctly knit, not being subject to said second braking means.

The second braking means comprise a plurality of discs supported freely by a support shaft and having for each thread 18 of said threads two discs facing one another and movable towards and away from one another.

The second recovery means comprise, for each thread, a hinged stem activated in its rotation by a fluid dynamic piston, said stem being movable in opposition to and by the action of a spring, said spring having means for adjusting its tension.

At one end opposite its hinge, the stem has an eyelet of an enlarged diameter such as to allow said thread to slide freely in order to produce said upper and during said rotation it engages with and disengages from said two discs so as to increase and decrease their friction on said thread.

The adjustment means for adjusting said spring comprise two plates clampable in a jaw arrangement onto a tightener for tightening said spring, said tightener being locked between said plates by a rubber gasket and by a threaded dowel.

The first recovery means comprise one or more weights that recover said thread at the outlet of said first braking means in a calibrated way, according to its type, so as to prepare it to start knitting said upper.

The machine also comprises means for shifting said dial in order to increase the zone for housing said upper during its production, said housing zone being comprised between said dial and said sinker crown.

The shifting means comprise at least two fluid dynamic pistons for lifting the motor holder plate for supporting the motor shaft, there being provided two regulators of the stroke of said plate.

The second recovery means comprise control means for controlling the breakage of said thread, having a pin that activates an electric signal when a slider of said thread comes into contact with it.

The connection means comprise an elastic tongue and/or eyelets and/or elastically deformable shaped areas.

The eyelets are made with said threads, each of which has undergone a first constant and adjustable braking through first braking means and at least a second extra braking activatable and deactivatable through second braking means.

The production of the heel of said upper and the change in direction of said upper are obtained with said first and second braking, with an increase or decrease in the working field of said upper.

The tongue of said upper is made with said elastic thread during the formation of said upper.

The upper has openings for increasing and positioning fixing points of a sole of said shoe.

It is also noted that at least the passages travelled by said upper of said sinker crown, said cup element and said cylinder have an increased diameter and said suction bell has an air negative pressure draft proportional to said increased diameter.

The selection means of said needles comprise a pre-selection cam defining a working path and a non-working path of the heels of the elastic jacks of the corresponding needles 9 and sub-needles of said cylinder and a lifting cam defining a first path for executing working stitches and a second path, which is lowered relative to the first path, for executing tuck stitches.

The first path and the second path, in said lifting cam, are defined, respectively, by the upper profile of the lifting cam and by a groove extending onto the face of said lifting cam facing towards said needle cylinder and they have an uphill section, a dwell section and a downhill section.

The working path, in said pre-selection cam, is defined by the upper profile of said pre-selection cam and said non-working path is defined by a recess, situated below said working path and having at least one downhill section for bringing the heel of the selection members, engaged in said non-working path, to a level such as not to be engaged in said first path or in said second path of said lifting cam.

The pre-selection cam has, upstream of a first group of selection actuators, an uphill section engageable with the heels of the selection members placed lower than the level of said second path of said lifting cam.

The pre-selection cam and the lifting cam have symmetrical profiles relative to an intermediate vertical axis thereof for the activation of the machine in the two directions of rotation.

The machine has four feeders and the plurality of cams of said selection means is comprised of four pre-selection cams alternating with four lifting cams.

BRIEF DESCRIPTION OF THE DRAWINGS

Additional features and advantages will become more apparent from the description of a preferred but not exclusive embodiment of the invention, illustrated by way of non-limiting example in the appended drawings, in which.

DETAILED DESCRIPTION

Figure 1:
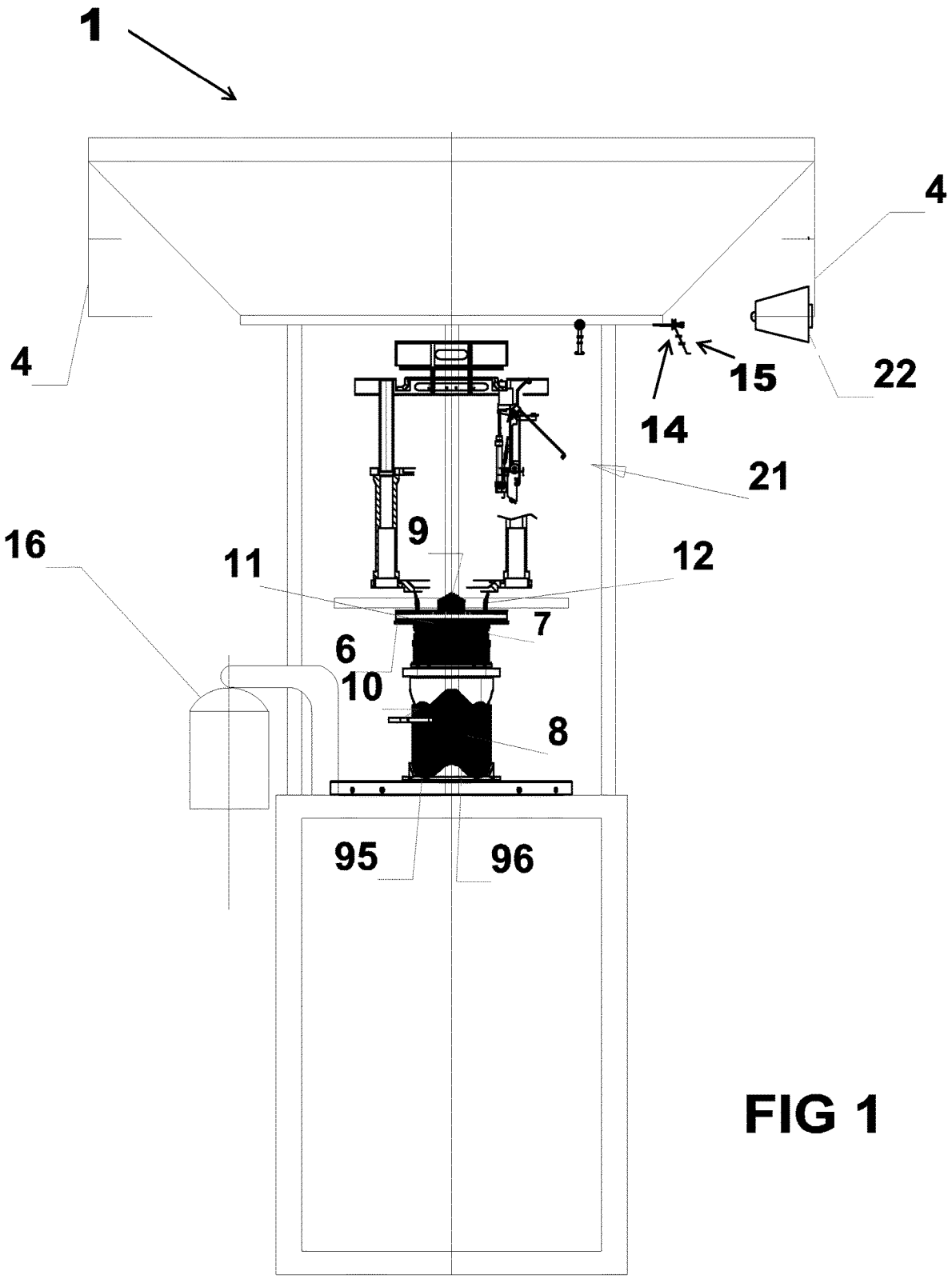
FIG. 1 is a schematic view of the machine according to the invention.
Figure 2:
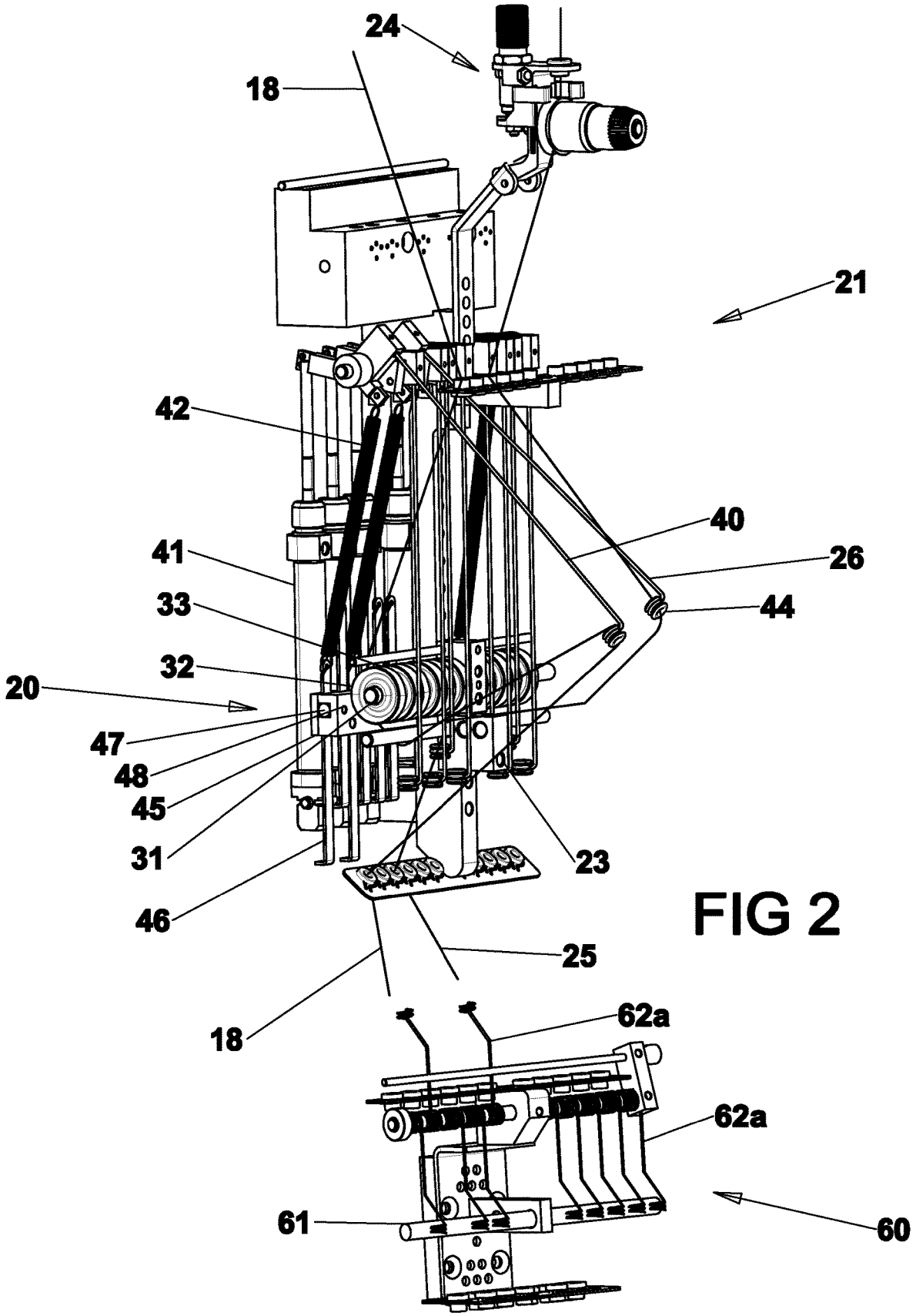
FIG. 2 is a view of the second recovery means, the second braking means and the safety means according to the invention.
Figure 3:
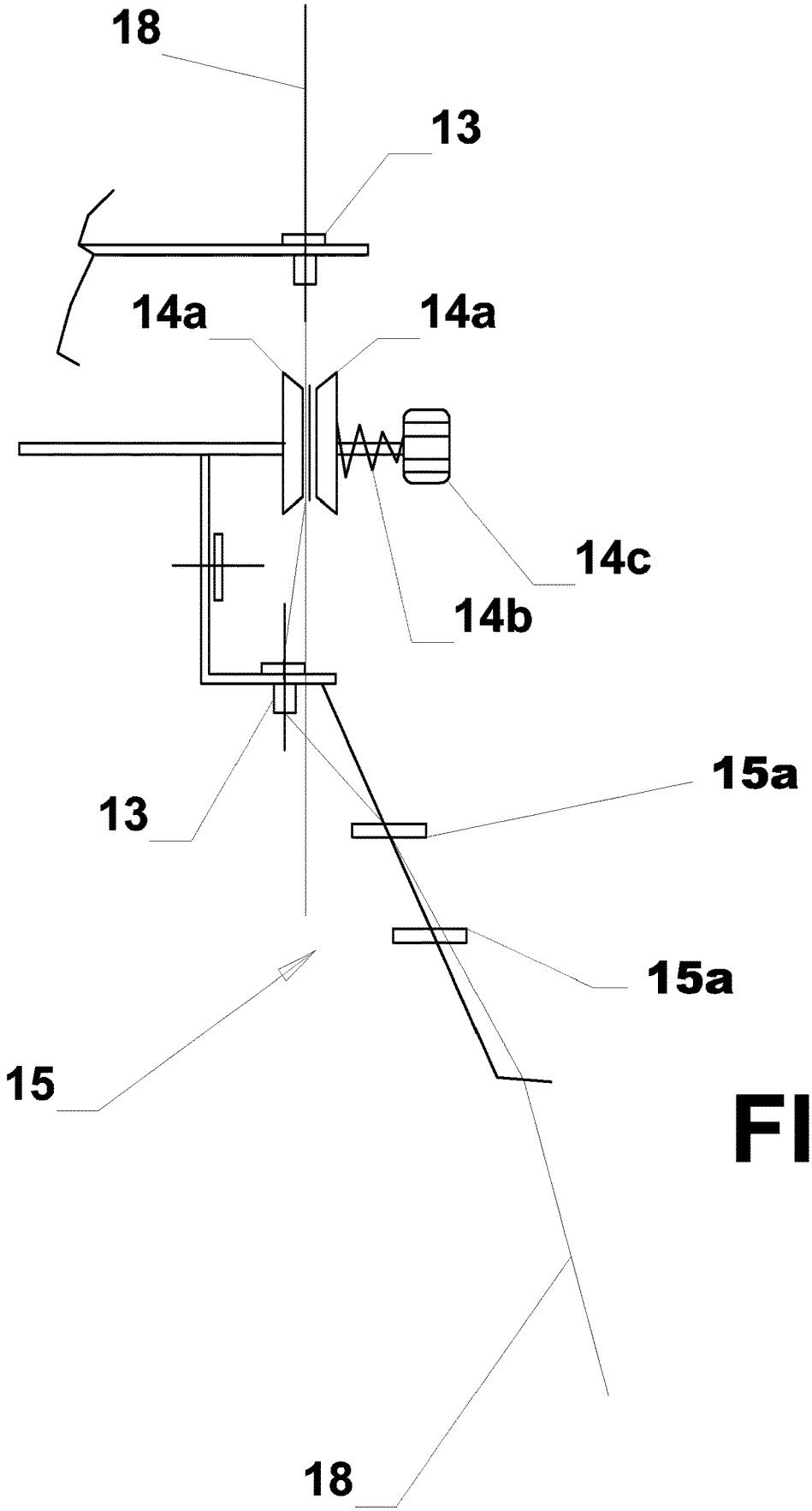
FIG. 3 is a schematic view of the first braking means of the first recovery means according to the invention.
Figure 4:
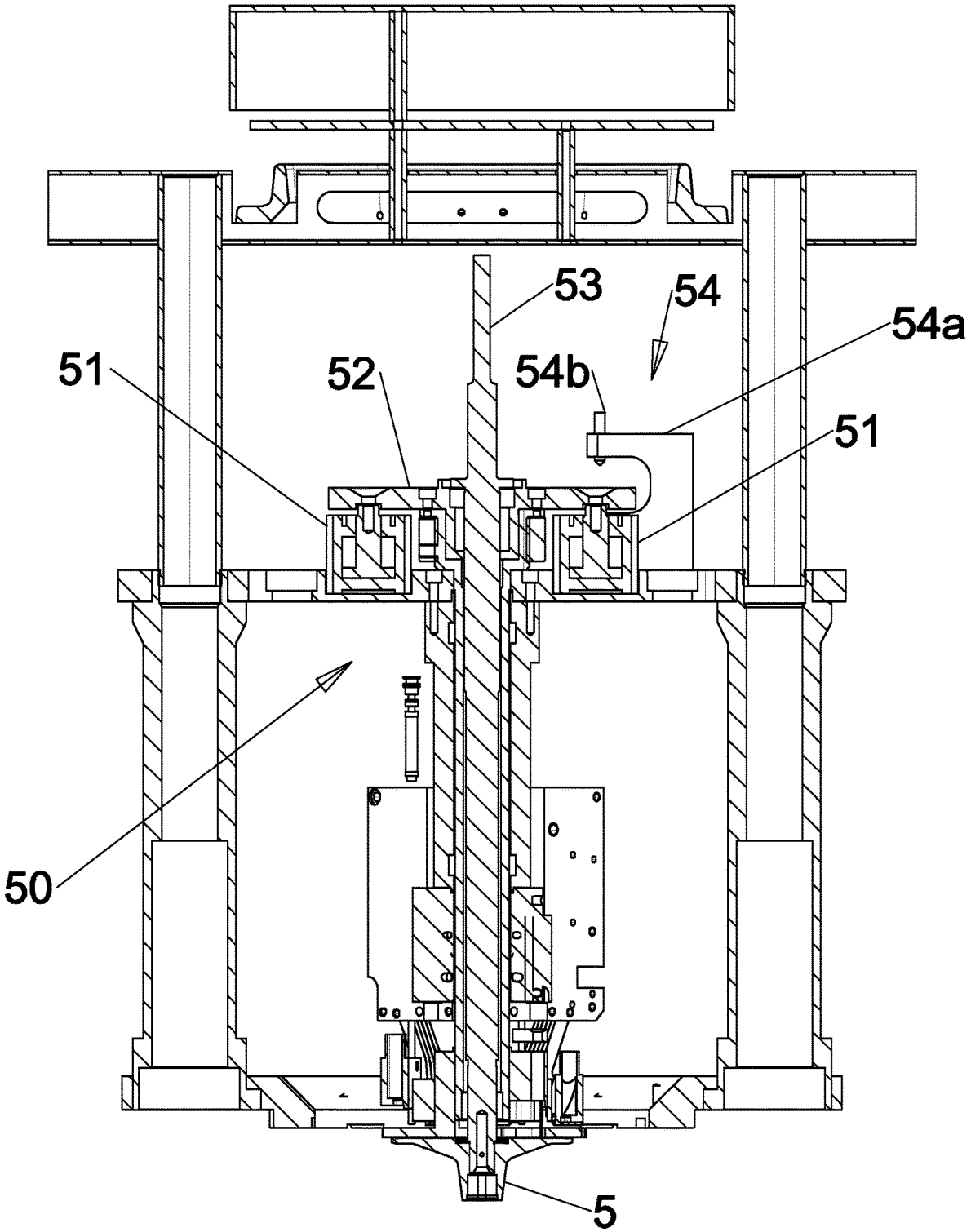
FIG. 4 is a view of the shifting means according to the invention.
Figure 5:
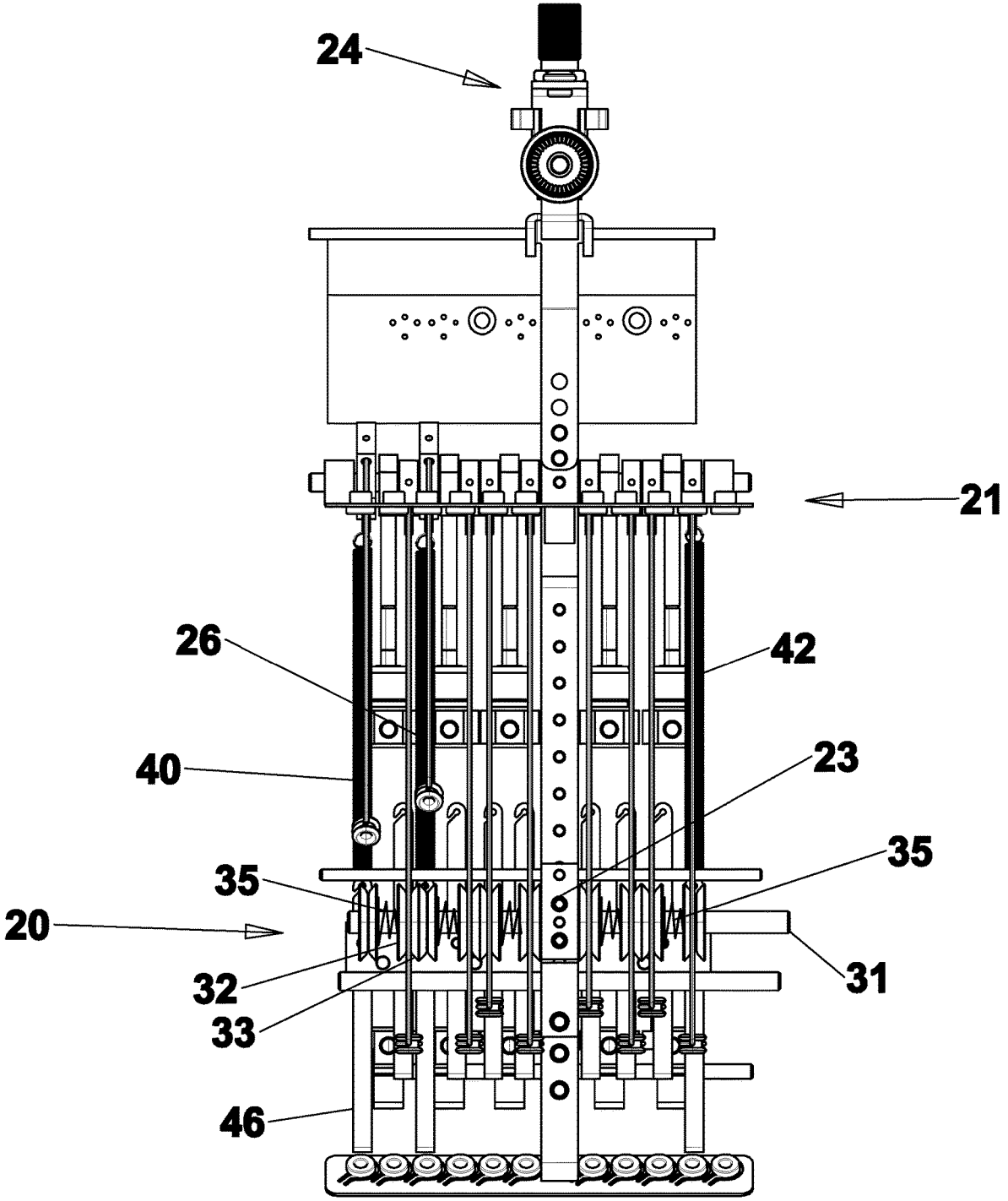
FIG. 5 is a front view of the second recovery means, of the second braking means according to the invention.
Figure 6:
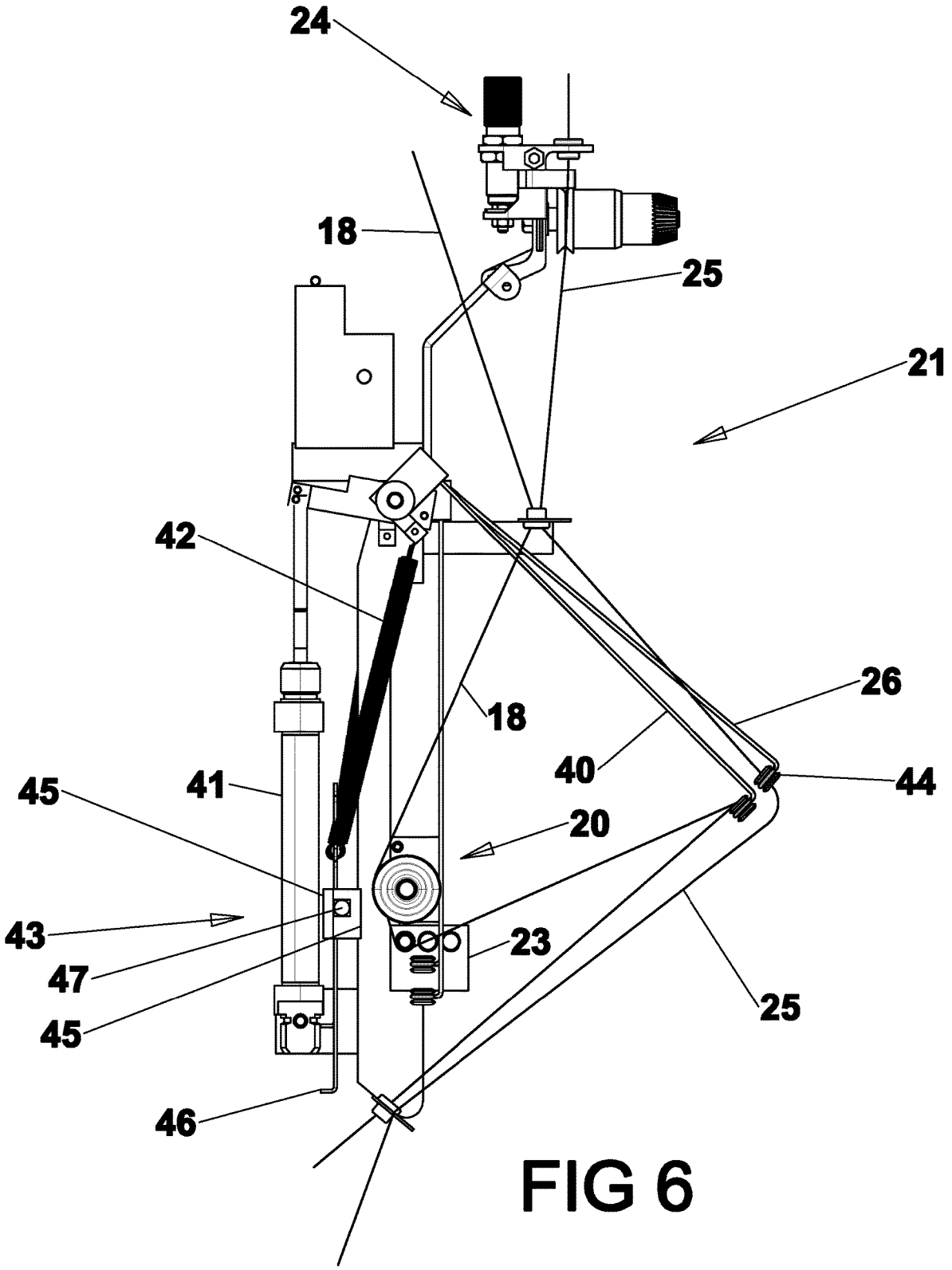
FIG. 6 is a side view of the second recovery means, of the second braking means according to the invention.
Figure 10:
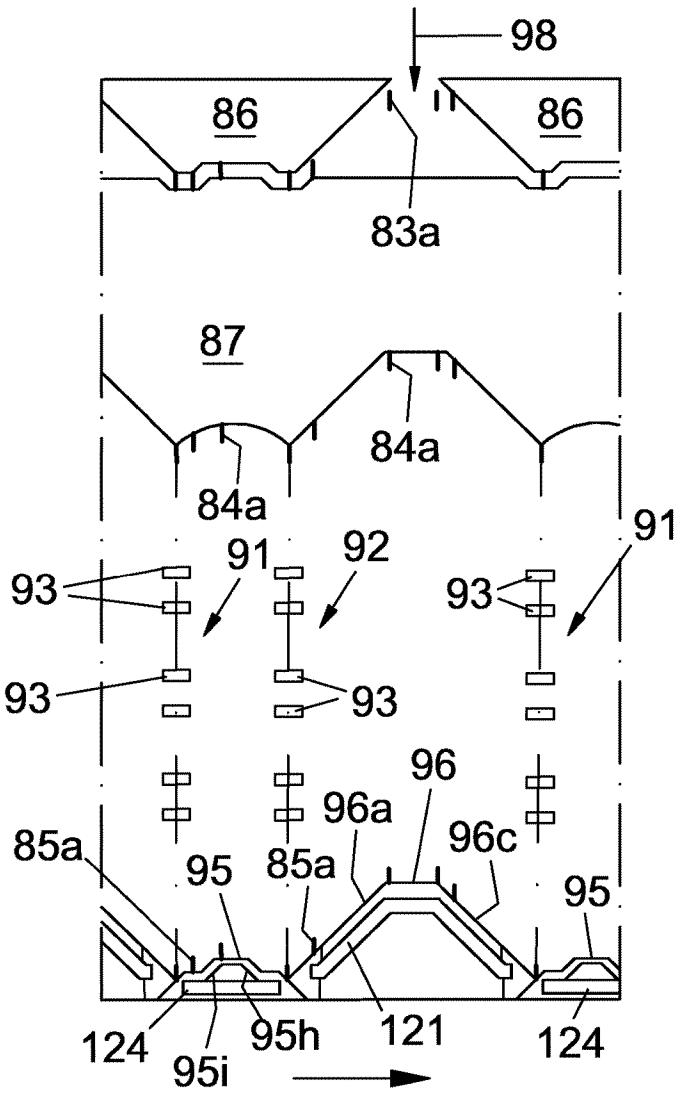
FIGS. 10, 11 and 12 are views of the normal working stitches and tuck stitches according to the invention.
Figure 7:
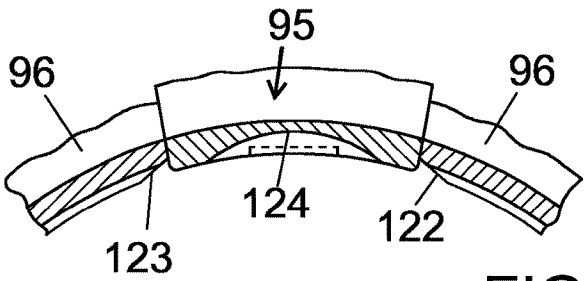
FIGS. 7 and 9 are views of the pre-selection cam according to the invention.
Figure 8:
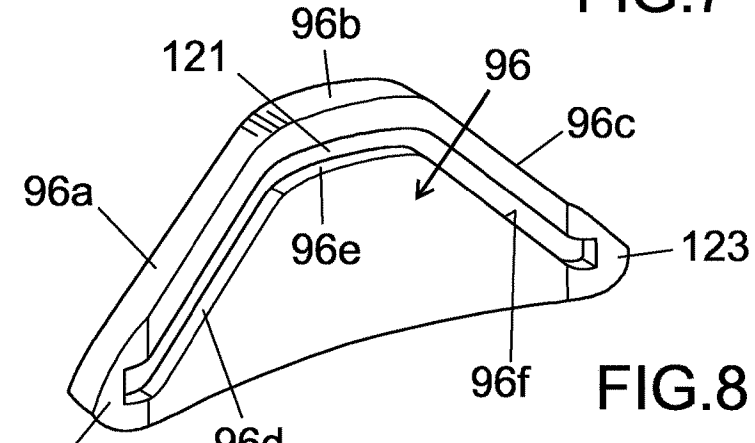
FIG. 8 is a view of the of the lifting cam according to the invention.
Figure 9:
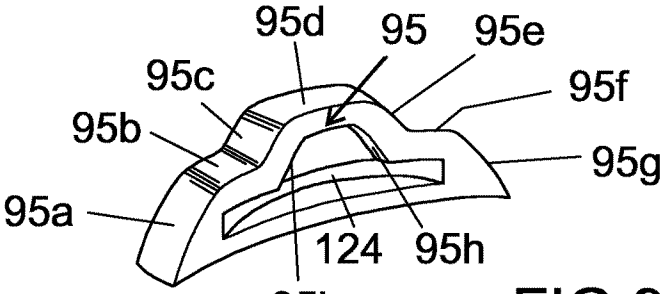
Figure 13:
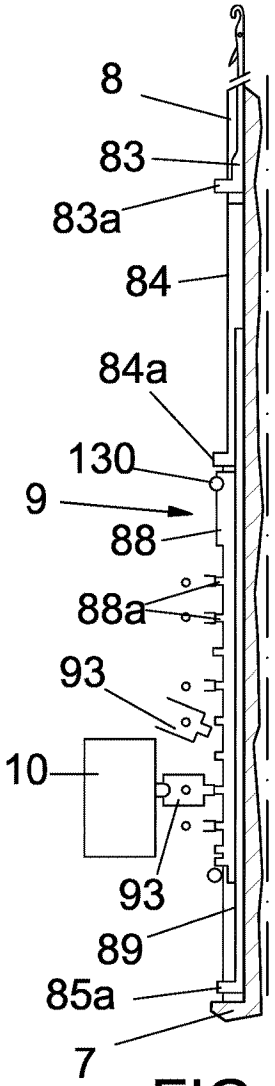
FIG. 13 is a view of the cylinder with the associated grooves and needles according to the invention.
Figure 12:
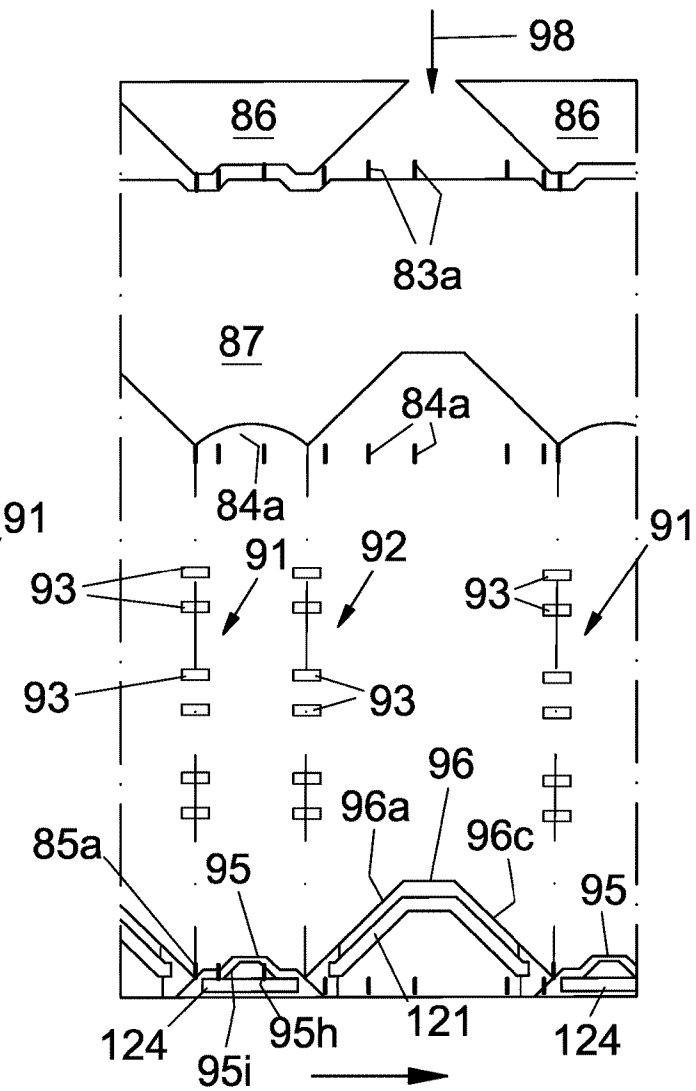
Figure 11:
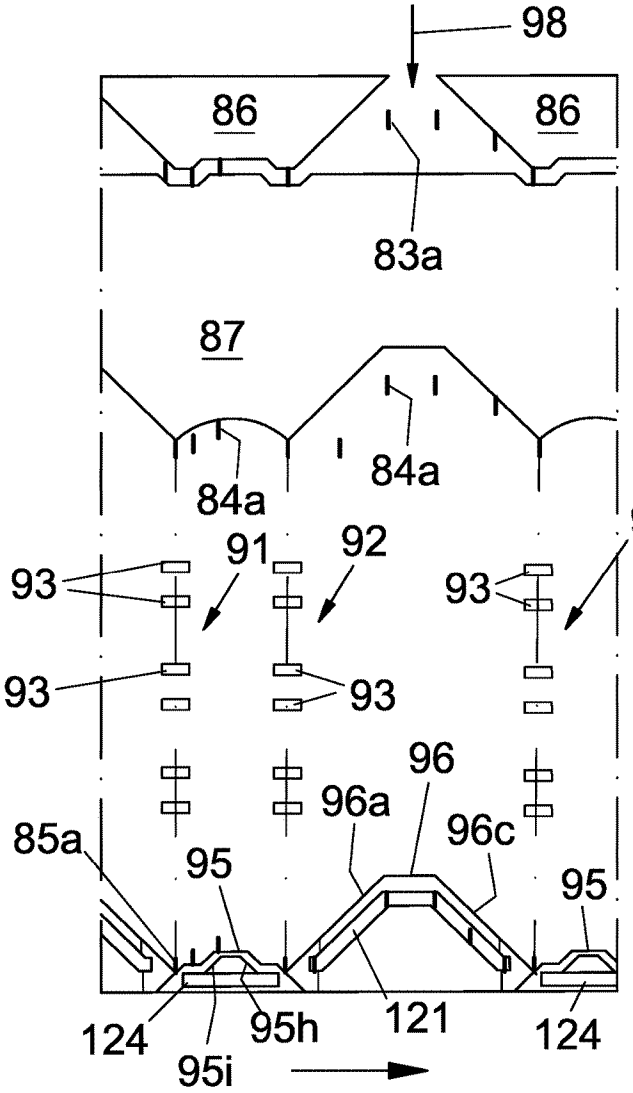
Figure 14:
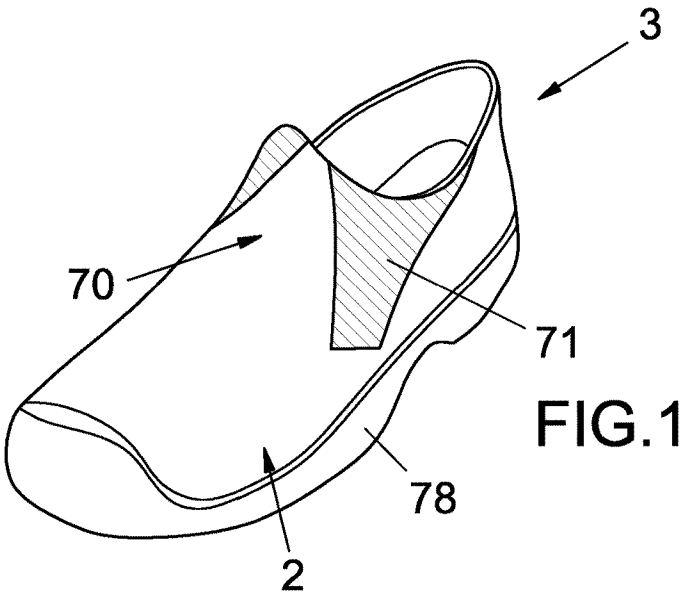
FIGS. 14, 15 and 16 show the upper connected to the sole to define different types of shoes according to the invention.
Figure 16:
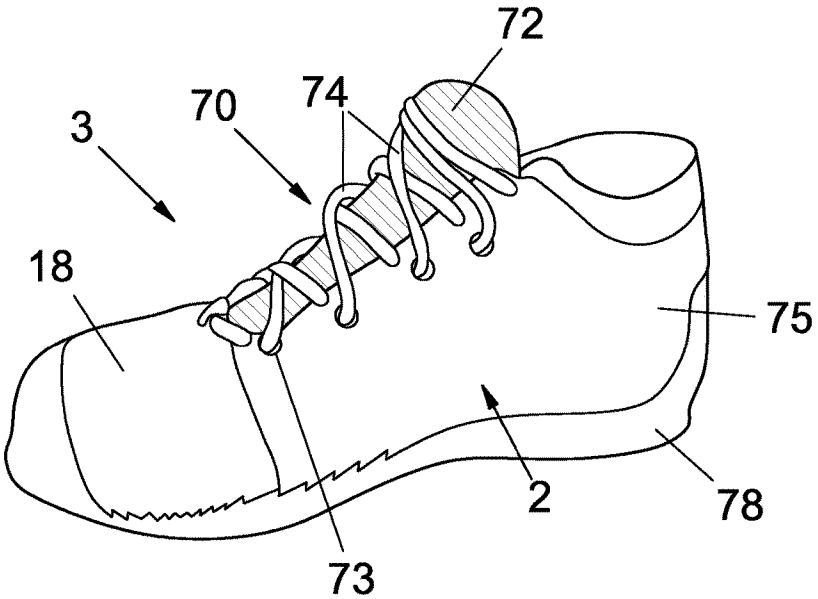
Figure 15:
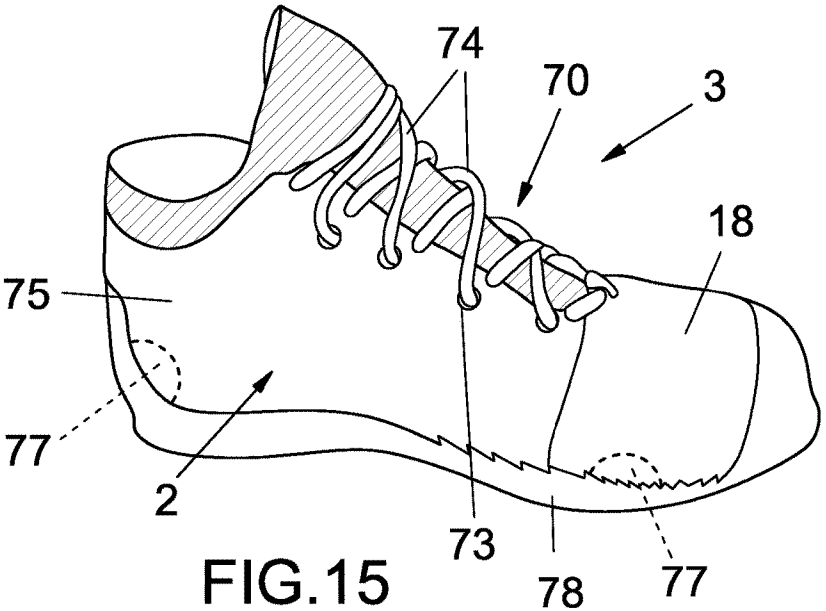

With particular reference to the above-mentioned figures, the machine for making an upper for a shoe is denoted in its entirety by the reference number 1.

The machine 1 comprises a reel holder rack 4, a dial 5 and a sinker crown 6, a needle cylinder 7 with a vertical axis and forward and backward movement (clockwise and anticlockwise).

The cylinder 7 has a plurality of grooves 8, inside of which the needles 9 are slidable, controlled by selection means 10.

The machine also has a cup element 11, at least four feeders 12 assembled along the circumference thereof, and guide means 13 for guiding the yarns used to make the upper 2 of the shoe 3.

After the first guide means 13 the machine has first braking means 14 for braking the yarns, and first recovery means 15 for recovering each of the threads 18 to be fed to the needles 9 to form the upper.

Below, the machine is equipped with a suction bell 16 for unloading the upper 2 therefrom.

In particular, the first braking means 14 present on the machine for making the upper 2 comprise, for each thread 18, two discs 14*a*, between which the thread 18 slides, and which by means of a spring 14*b* and an adjustment screw 14*c* can create more or less friction on the thread being processed.

Present after the first braking means 14 are the first recovery means 15; they have the task of recovering the thread 18, which forms a loop.

This loop of the thread not in tension is formed during the repeated openings/closings of the stem 40 of the second recovery means and is reduced using said first recovery means 15, which comprise ceramic rings 15*a* which with their weight and by sliding on the stem 15*b* keep each thread 18 in tension and ready for the moment in which the knitting process must resume.

By varying the weight of the rings 15*a* or adding more rings it is possible to calibrate the correct tension for the different types of thread used and the different physical characteristics thereof according to the technical characteristics of the upper 2 to be made.

The particular programming of the work of the needles 9 in order to form the upper 2 on different feeds, and the use of yarns with particular physical characteristics suitable for making all types of uppers with different technical characteristics, has been possible also by virtue of the fact that the oscillation of the stem 40 of the second recovery means is very wide and capable of recovering the excess millimetres of thread due to the reciprocal motion of the cylinder and depending on its physical characteristics.

In this manner, in fact, despite there being a considerable increase in the thread 18 to be recovered because of its physical characteristics, the stem 40 for each thread is capable of recovering the thread from the processing, without unwinding a part of thread from the respective reel 22 with the undesirable result of an overall, and thus detrimental, increase in the millimetres of thread to be recovered.

Conveniently, the machine comprises at least second braking means 20 for braking or locking each thread 18 for forming the upper during at least the first part of the return movement of the needle holder cylinder 7 and second recovery means 21 in order to recover the thread 18 from the cylinder 7, preventing its recovery by the respective reel 22.

The second braking means 20, moreover, make it possible to have the thread 18 coming from the reel 22 more braked during the first part of the reverse movement of the cylinder so as to prevent, precisely, it from being unwound from the reel when the stem 16*a* must recover the thread from the last needle that has worked.

Advantageously, moreover, the second braking means 20 are activated and deactivated directly by the second recovery means 21, thus permitting an enormous simplification of the machine whilst at the same time ensuring a perfect synchronisation of work.

In particular, the second braking means 20 are supported by an adjustable support element 23 which can be manually or automatically shifted at different distances from the second recovery means 21 in order to anticipate or delay the activation of the second braking means 20.

The machine according to the invention must also be equipped with third braking means 24 which act only on at least one elastic thread 25 of the threads 18 that form the upper 2.

In fact, some parts of the upper, which could be the tongue of the upper or the zones adjacent to where the upper must be held on the foot of the user, are elastically yielding and must be made with an elastic thread or a number of elastic threads 25 having different physical characteristics.

In this case, unlike the second braking means, the third braking means 24 are activated directly by the management program of the machine 1 while the upper is being made.

The recovery of the elastic thread 25 is carried out by third recovery means 26 only and exclusively acting on said elastic thread on it, since for mechanical reasons it must be subjected to the least friction and tension possible in order to be correctly knitted, since, by its very nature, it cannot be subjected to the second braking means.

More precisely, the second braking means 20 comprise a plurality of discs 30 supported freely by a support shaft 31.

Making reference to each thread 18 for the construction of the upper, the second braking means 20 comprise two discs 32 and 33 facing one another and movable towards and away from one another.

After being passed between the discs and having been adequately braked, the thread 18 is recovered by the second recovery means 21, which are defined by a hinged stem 40 activated in its rotation by a fluid dynamic piston 41.

The stem 40 is movable in opposition to and by the action of a spring 42, which has means 43 for adjusting its tension.

In particular the stem 40 has, at its end opposite its hinge, a ceramic eyelet 44 with a low coefficient of friction and an enlarged diameter such as to allow said thread 18 to slide freely in order to make said upper irrespective of its count and its physical characteristics.

Advantageously, the stem 40, during its rotation, is engaged to and disengaged from the two discs 32 and 33, by moving them progressively away thanks to their flared surfaces, or permitting them to move nearer, so as to increase and decrease their friction on the thread.

As seen, the stem 40 is movable in opposition to and by the action of a spring 42, which has adjustment means 43 comprising two plates 45 clampable in a jaw arrangement onto a tightener 46 for tightening the spring, which conveniently, irrespective of the force of the spring, is locked between the plates simultaneously by a rubber gasket 47 and by a threaded dowel 48.

It should also be pointed out that the stems 40 can normally be straight, but at least one of them, for example the one that engages with the elastic thread, could have a bend in a direction that is favourable to avoid mechanical members that create angles and consequently pointless friction on the elastic threads, which must have the least friction and tension possible in order for them to be correctly knitted.

Conveniently, the machine according to the invention comprises means 50 for shifting the dial so as to increase the zone housing the upper during its production in order to enable better processing of the rich zones of the tip and heel of the upper.

In fact, the housing zone that is comprised in the area where the knitted courses of the upper are formed between the dial and the sinker crown must be very wide since use is made of particular yarns, suitable for making the upper, which consequently occupy a considerable volume.

Furthermore, the upper 2 meets resistance in the passage towards the unloading outlet and the threads being processed are forced between the upper and the dial, preventing their recovery during the reciprocal motion of the cylinder or the clockwise and anticlockwise rotations thereof.

For the same technical reasons, at least the passages travelled by the upper and relative to the sinker crown 6, the cup element 11 and the cylinder have an increased diameter.

Consequently, the suction bell has an air negative pressure draft proportional to the increased diameter.

More generally, in the machine 1 all the diameters of the parts where the upper must pass, starting, as said, from the internal sinker crown, from the brass bushing, to the brass cup element, to the cylinder holder where the same passes, have been enlarged to ensure that the upper is not blocked or, in the case of the cup element, that the pocket of the heel of the upper does not remain too far up.

For the same reason, the machine 1 has all the bends of the tubes conveying the upper to the unloading outlet connected by means of the suction bell.

In particular, the shifting means 50 comprise at least two fluid dynamic pistons 51 for lifting the motor holder plate 52 for supporting the motor shaft 53.

Laterally to the pistons there are provided regulators of the stroke 54 of the disc defined by two "C"-shaped elements 54*a* with respective limit stop dowels 54*b*.

The second recovery means comprise control means 60 for controlling the breakage of the thread 18 and they assure an immediate stop of the machine 1 so as to prevent all the problems that can derive from this situation.

The control means 60 have a pin 61 that activates an electric signal when a slider 62 of the thread comes into contact with it, since it is conveyed into this position by gravity as soon as the breakage of the thread interrupts the retention of the slider 62 in the working position.

The present invention further relates to an upper for shoes.

The upper obtained according to the invention has connection means, denoted in their entirety by the number 70, for holding it onto the neck of the foot of the user.

In particular, the connection means 70 are provided on the upper 2 simultaneously with its formation on the machine 1 and comprise elastically deformable shaped areas and/or an elastic tongue and/or eyelets 73.

The eyelets 73 are made with the threads 18, each of which has undergone a first constant and adjustable braking through first braking means 14 and at least a second extra braking activatable and deactivatable through second braking means 20.

Every thread 18 of the upper 2 undergoes a first constant and adjustable braking through the first braking means 14 and at least a second extra braking activatable and deactivatable through the second braking means 20.

Advantageously, the production of the heel 75 of the upper and the change in the direction thereof are likewise obtained with the first and second braking with an increase or decrease of the working field of the upper.

During its production, the upper 2 has openings 77 for increasing and positioning fixing points of a sole 78 of the shoe 3.

Furthermore, the machine is equipped with a system, as seen, of cams of the lower casing for independent needle-by-needle selection on the 4 feeders in a clockwise and anticlockwise direction in order to obtain the three technical ways of knitting.

The suction nozzles have a thread-stop pin to obviate the problems of threads recovered between the various feeders during the reciprocal motion of the cylinder.

The machine also has a double thread braking felt pad and four separate elastic clamps on the four feeders mounted on the suction nozzles.

The thickness of the sinker has been increased in order to work with thicker yarns and have a wider knit and better interknitting.

Advantageously, the optimisation of operation and simplification of the machine 1 during production of the upper is obtained through selection means 10 for selecting the needles 9 which comprise a pre-selection cam 95 defining a working path and a non-working path of the heels of the elastic jacks of the corresponding needles and sub-needles of the cylinder and a lifting cam 96 defining a first path for executing working stitches and a second path, which is lowered relative to the first path, for executing tuck stitches.

In particular, the machine 1 has each feed made up of a pre-selection cam 95 disposed between two groups of selection actuators which refer to that feed and define a working path and a non-working path for the heel 85*a* of the elastic jacks 89, and a lifting cam 96, which is disposed downstream of the second group of selection actuators and defines at least two paths for the heel of the elastic jacks, i.e. a first path for executing normal working stitches, and a second path, which is lowered relative to the first path, for executing tuck stitches.

The machine has four feeds and four pre-selection cams 95 alternating with four lifting cams 96. More particularly, the lifting cam 96 has an upper profile with a uphill section 96*a* upstream of the feed, a dwell section 96*b* at the feed and a downhill section 96*c* downstream of the feed, which together make up the first path mentioned.

On the other hand, the second path, is made up of a groove 121 which is defined on the face of the cam 96 facing towards the needle cylinder and extends, at a lower level, parallel to the upper profile of the cam, i.e. the second path, too, is made up of an uphill section 96*d*, a dwell section 96*e* and a downhill section 96*f*.

The lifting cam thus has a substantially trapezoidal profile and, on its face facing towards the needle cylinder, at the corners of its larger base, there are two cutaway parts 122 and 123, whose function will be better clarified below.

In order to enable equal operation in both one direction of rotation of the needle cylinder and the other, the lifting cam is symmetrical relative to an intermediate vertical axis.

The working path of the pre-selection cam 95 is formed by the upper profile of the cam itself, which has an uphill section 95*a*, a dwell section 95*b*, a further uphill section 95*c*, a further dwell section 95*d*, a downhill section 95*e*, a dwell section 95*f* and a further downhill section 95*g*.

On the other hand, the non-working path, is defined by a recess 124 on the face of the pre-selection cam facing towards the needle cylinder.

The recess 124 determines, for the heel of the elastic jacks, at least one downhill section 95*h* for conveying the heel to a lower level relative to the entry of the second path of the lifting cam.

The pre-selection cam, too, will be symmetrical relative to an intermediate vertical axis to enable equal operation in the two directions of rotation of the needle cylinder.

For this reason, the recess 124 will have a downhill section 95*i* also in the other direction of rotation.

The opposite longitudinal ends of a pre-selection cam are inserted between two lifting cams at the cutaway parts 122 and 123.

The cams of the sub-needles and needles also have uphill sections to enable the sub-needles and needles to be raised under the action of the elastic jacks, and downhill sections to convey them back into the initial position at the next feed.

Based on what has been described, the operation of the machine with the selection device according to the invention is as follows.

The direction of the needles in their motion relative to the cams during the execution of normal working stitches is indicated with an arrow; the first group of selection actuators 91 does not act upon the selectors 88 and thus the heel 85*a* of the elastic jacks 89 projects from the grooves 8 of the cylinder 7 of the needles 9 and engages with the upper profile of the pre-selection cam 95, which causes a lifting of the elastic jacks and hence of the corresponding sub-needles and needles.

At the end of the pre-selection cam 95, the heel of the elastic jacks is substantially brought back to the initial level by the needle cams 86 and sub-needles 87.

The second group of selection actuators 92, in turn, does not act on the selectors 88 and thus the heel 85*a* of the elastic jacks engages with the upper profile of the lifting cam 96, i.e. it follows the first path.

By virtue of the uphill section 96*a* of said cam, the corresponding needles are lifted to a height where, before the tip of the needles engages the yarn at the feed, the previously formed loop is pulled down over the needle shafts below the needle latch so as to produce normal working stitches.

During the execution of tuck stitches, the first group of selection actuators 91 does not intervene and the same situation as described is repeated solely for the pre-selection cam.

The second group of selection actuators 92 acts on the selectors 88, thus withdrawing the heels 85*a* of the elastic jacks into the grooves 82 of the needle cylinder.

When the action of the group of selection actuators 92 has ended, the heel of the elastic jacks once again projects from the grooves of the needle cylinder for the reason explained previously, but the withdrawal it has undergone is sufficient in order for the heels of the elastic jacks to be conveyed between the lifting cam 96 and the needle cylinder.

Considering that, at the second group of selection actuators 92 the heels of the elastic jacks are positioned at the level of the entry of the groove 121, the heels of the elastic jacks engage in that groove, i.e. they follow the second path of the lifting cam 96.

Since this path extends below the first path, the corresponding needles are lifted to a height where, although the tip of the needles engages the yarn from the feed, the previously formed loop is not discharged onto the needle shaft, i.e. tuck stitches are made.

When it is desired to exclude needles at the feed considered from the process, the first group of selection actuators 91 acts on the selectors 88 and causes the heels 85*a* of the elastic jacks 89 to withdraw into the grooves of the needle cylinder.

Once the effect of the selection actuators 91 has ended, the heels 85*a* project from the grooves 82 between the pre-selection cam 95 and the needle cylinder, engaging in the recess 124, i.e. they follow the non-working path. On encountering the downhill section 95*h*, the heels 85*a* are conveyed to a level that is lower than the two paths defined by the lifting cam and thus remain withdrawn inside the grooves of the needle cylinder until beyond the feed considered.

In this case, the corresponding needles cannot pick up the yarn at this feed.

Upstream of the feed following the one considered, thanks to the cutaway part 123 of the lifting cam 96, the heels 85*a* can partially project from the needle cylinder and engage with the uphill section 95*a* of the pre-selection cam so as to be conveyed back to a level at which it can undergo the action of the first group of selection actuators located upstream of the subsequent feed.

An analogous operation is obtained during the motion of the needle cylinder in the opposite direction thanks to the symmetry and arrangement of the various cams, whereby the function of the groups of selection actuators 91 and 92 is reversed.

Advantageously, in this manner the execution of normal working stitches and the execution of tuck stitches only requires two groups of selection actuators per feed and the profile of the needle cams is simplified, since they have the sole function of lowering the needles after they have engaged the yarn from a pre-established feed.

Furthermore, thanks to this simplification of the needle cams, one avoids the breakage thereof, even if they are not precisely positioned.

The present invention further relates to an upper.

The upper obtained according to the invention has connection means, denoted in their entirety by the number 70, for holding it onto the neck of the foot of the user.

In particular the connection means 70 are provided on the upper 2 simultaneously with its formation in the machine 1 and comprise elastically deformable shaped areas and/or an elastic tongue 72 and/or eyelets 73.

The eyelets 73 are made with the threads 18, each of which has undergone a first constant and adjustable braking through first braking means 14 and at least a second extra braking activatable and deactivatable through second braking means 20.

Each thread 18 of the upper 2 undergoes a first constant and adjustable braking through the first braking means 14 and at least a second extra braking activatable and deactivatable through the second braking means 20.

Advantageously, the production of the heel 75 of the upper and the change in the direction 76 thereof are likewise obtained with the first and second braking with an increase or decrease of the working field of the upper.

The tongue 72 is made with the elastic thread during the formation of the upper which, conveniently, during its production, has openings 77 for increasing and positioning fixing points of a sole 78 of the shoe 3.

Advantageously, the machine 1 further envisages that the movement of the cam pushrods is pneumatically driven.

Furthermore, the machine is equipped with a system, as seen, of cams of the lower casing for independent needle-by-needle selection on the 4 feeders in a clockwise and anticlockwise direction in order to obtain the three technical ways of knitting.

The suction nozzles have a thread-stop pin to obviate the problems of threads recovered between the various feeders during the reciprocal motion of the cylinder.

The machine also has a double thread braking felt pad and four separate elastic clamps on the four feeders mounted on the suction nozzles.

The thickness of the sinker has been increased in order to work with thicker yarns and have a wider knit and better interknitting.

The machine and the upper, as well as the shoe, according to the invention are susceptible of numerous modifications and variants, all of which falling within the scope of the inventive concept; furthermore, all details may be replaced with technically equivalent elements.

The materials used, as well as the dimensions, may be of any type according to needs and the state of the art.

The invention claimed is:

1. A machine for making an upper for a shoe comprising: a reel holder rack, a dial and a sinker crown, a needle cylinder with a vertical axis and forward and backward movement having a plurality of grooves inside of which the needles are slidable controlled by a selection system thereof, at least four feeders assembled along the circumference of the machine, a guide, a first brake, a first recovery system for recovering each of the threads to be fed to said needles for forming the upper and a suction bell for unloading said upper, below said first brake at least a second brake being present for braking or locking each thread for the formation of said upper during at least the first part of a return movement of said needle holder cylinder and a second recovery system for recovering said thread from said cylinder preventing its recovery by a reel of said reels, said second brake being activated and deactivated by said second recovery system.

2. The machine according to claim 1, wherein said second brake are supported by an adjustable support element at different distances from said second recovery system for delaying the activation of said second brake.

3. The machine according to claim 1, further comprising a third brake that only act on at least one elastic thread of said threads that form said upper, said third brake being activated directly by the management program of said machine while said upper is being made.

4. The machine according to claim 1, further comprising a third recovery system only acting on said elastic thread which must be subjected to the lowest friction and tension possible for its correct knitting not being subject to said second brake.

5. The machine according to claim 1, wherein said second brake comprise a plurality of discs supported freely by a support shaft and having for each thread of said threads two discs and facing one another and movable towards and away from one another to vary the friction value of said discs on said thread.

6. The machine according to claim 1, wherein said second recovery system comprise for each thread a stem hinged and activated in its rotation by a fluid dynamic piston, said stem being movable in opposition to and by the action of a spring, said spring having an adjustable tension.

7. The machine according to claim 1, wherein said stem during said rotation is engaged and disengaged from said two discs and for increasing and decreasing their friction on said thread.

8. The machine according to claim 1, wherein said spring is configured to be adjusted by two plates clampable in a jaw arrangement onto a tightener for tightening said spring, said tightener being locked between said plates by a rubber gasket and by a threaded dowel.

9. The machine according to claim 1, wherein said first recovery system comprise one or more weights that tighten said thread at the outlet from said first brake in a calibrated way according to its type so as to prepare it for starting to knit said upper.

10. The machine according to claim 1, a shifter shifting said dial for increasing the housing zone of said upper during its production, said housing zone being comprised between said dial and said sinker crown.

11. The machine according to claim 1, wherein the shifter comprises at least two fluid dynamic pistons for lifting the motor holder plate for supporting the motor shaft, being provided with two regulators of the stroke of said plate.

12. The machine according to claim 1, wherein said second recovery system is configured to control the breaking of said thread having a pin that activates an electric signal when a slider of said thread comes into contact with it.

13. The machine according to claim 1, wherein at least the passages travelled by said upper of said sinker crown, said cylinder have an increased diameter and in that said suction bell has an air negative pressure draft proportional to said increased diameter.

14. The machine according to claim 1, wherein said selection system of said needles comprise a pre-selection cam defining a working path and a non-working path of the heels of the elastic jacks of the corresponding needles and sub-needles of said cylinder and a lifting cam defining a first path for the execution of working stitches and a second lowered path with respect to the first path for the execution of tuck stitches.

15. The machine according to claim 1, wherein said first path and said second path, in said lifting cam, are defined by the upper profile of the lifting cam and by a groove extending onto the face of said lifting cam facing towards said needle cylinder, respectively.

16. The machine according to claim 1, wherein said first and said second path, in said lifting cam, have an uphill section, a dwell section and a downhill section.

17. The machine according to claim 1, wherein said working path, in said pre-selection cam, is defined by the upper profile of said preselection cam and in that said non-working path is defined by a recess, situated below said working path and having at least one downhill section for bringing the heel of the selection members, engaged in said non-working path, to a level such as not to be engaged in said first path or in said second path of said lifting cam.

18. The machine according to claim 1, wherein said pre-selection cam has, upstream of a first group of selection actuators, an uphill section engageable with the heels of the selection members placed lower than the level of said second path of said lifting cam.

19. The machine according to claim 1, wherein said pre-selection cam and said lifting cam have symmetrical profiles with respect to an intermediate vertical axis thereof for the activation of the machine in the two rotation directions.

20. The machine according to claim 1, further comprising four feeders and in that said plurality of cams of said selection system is comprised of four pre-selection cams alternating with four lifting cams 96.

* * * * *